US006971941B2

(12) United States Patent
Kaneko et al.

(10) Patent No.: US 6,971,941 B2
(45) **Date of Patent: *Dec. 6, 2005**

(54) ATTACHMENT FOR MOTOR FOR TOY

(75) Inventors: Yoshinobu Kaneko, Tokyo (JP); Yousuke Yoneda, Tokyo (JP); Yoshio Suimon, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/798,273

(22) Filed: Mar. 12, 2004

(65) Prior Publication Data

US 2005/0075040 A1 Apr. 7, 2005

Related U.S. Application Data

(63) Continuation of application No. 10/056,073, filed on Jan. 28, 2002, now Pat. No. 6,783,423.

(51) Int. Cl.[7] ..... A63H 17/00
(52) U.S. Cl. ..... 446/269; 446/457
(58) Field of Search ..... 446/269, 457, 446/461, 470, 90, 456, 463, 462; 180/65.1; 310/64, 91

(56) References Cited

U.S. PATENT DOCUMENTS

| | | | |
|---|---|---|---|
| 3,041,485 | A | 6/1962 | Jolley |
| 3,293,462 | A | 12/1966 | Wright |
| 3,622,822 | A | 11/1971 | Loftstrand |
| 3,628,284 | A | 12/1971 | Soulakis et al. |
| 3,634,969 | A | 1/1972 | Hartling et al. |
| 3,733,744 | A | 5/1973 | Hiltpold et al. |
| 3,827,181 | A | 8/1974 | Mabuchi |
| 3,959,921 | A | 6/1976 | Klint |
| 3,977,758 | A | 8/1976 | Mabuchi |
| 4,005,320 | A | 1/1977 | Mabuchi et al. |
| 4,028,571 | A | 6/1977 | Dicke |
| 4,073,086 | A | 2/1978 | Ogawa |
| 4,183,173 | A | 1/1980 | Ogawa |
| 4,406,085 | A | 9/1983 | Rhodes |
| 4,511,343 | A | 4/1985 | Goldfarb et al. |
| 4,684,355 | A | 8/1987 | Urakawa et al. |
| 4,764,150 | A | 8/1988 | Uchino |
| 4,878,877 | A | 11/1989 | Auer et al. |
| 4,889,516 | A | 12/1989 | Auer et al. |

(Continued)

FOREIGN PATENT DOCUMENTS

| | | |
|---|---|---|
| GB | 1145812 | 4/1969 |

(Continued)

OTHER PUBLICATIONS

IBM Tech. Discl. Bulletin, "Electrical Connection of a Motor Without the Use of Cables", vol. 30, No. 9, p. 138, Feb. 1998.
Combined Search and Exam. Report in Counterpart Appln GB 02055267 dated Aug. 23, 2002.
U.S. Appl. No. 10/056,073, filed Jan. 28, 2002, Kaneko et al.

*Primary Examiner*—Jacob K. Ackun
*Assistant Examiner*—J Williams
(74) *Attorney, Agent, or Firm*—Staas & Halsey LLP

(57) ABSTRACT

An attachment structure for motor and a racing vehicle toy, wherein a motor can easily be inserted and removed therefrom, including a motor holding plate pivoting relative to a toy chassis between an open position for opening the motor containing part and a close position for closing the motor containing part. The motor holding plate includes a member to elastically engage the chassis, when the motor holding plate is in the closed position, thereby holding the motor in the motor containing part.

42 Claims, 7 Drawing Sheets

U.S. PATENT DOCUMENTS

| | | | |
|---|---|---|---|
| 5,045,013 | A | 9/1991 | Fujitani |
| 5,343,102 | A | 8/1994 | Mabuchi et al. |
| 5,621,260 | A | 4/1997 | Fukuoka et al. |
| 5,762,533 | A | 6/1998 | Tilbor et al. |
| 5,835,006 | A | 11/1998 | Michalak et al. |
| 5,889,349 | A | 3/1999 | Yasuda |
| 5,986,367 | A | 11/1999 | Tsuzaki et al. |
| 6,074,271 | A | 6/2000 | Derrah |
| 6,508,322 | B2 | 1/2003 | Jones |
| 6,631,774 | B2 | 10/2003 | Hayashi |
| 2002/0094752 | A1 | 7/2002 | Kaneko et al. |
| 2003/0143921 | A1 | 7/2003 | Yoneda |

FOREIGN PATENT DOCUMENTS

| | | |
|---|---|---|
| GB | 1278362 | 6/1972 |
| GB | 1375723 | 11/1974 |
| GB | 2201549 | 9/1988 |
| GB | 2313427 | 11/1997 |
| JP | 10-084649 | 3/1998 |
| JP | 10-084650 | 3/1998 |
| JP | 11-98756 | 4/1999 |

ATTACHMENT FOR MOTOR FOR TOY

This application is a continuation of application Ser. No. 10/056,073, filed Jan. 28, 2002, entitled ATTACHMENT STRUCTURE FOR MOTOR FOR TOY, TOY WITH ATTACHMENT STRUCTURE, AND RACING CAR TOY, now U.S. Pat. No. 6,783,423.

1. FIELD OF THE INVENTION

The present invention relates to an attachment structure for a motor, especially to an attachment structure for a motor for a toy. The present invention relates to, for example, an attachment structure particularly usefully adapted to a motor which is frequently attached and detached. The present invention also relates to a toy with the attachment structure for a motor and a racing vehicle toy.

2. DESCRIPTION OF RELATED ART

In general, motors serve as power sources in, for example, various toys. The power of the motor is transmitted to actuating parts (in a running toy, they are wheels, or in a robot toy or a doll toy, they are arms and legs) through gear mechanisms.

It is to be noted that when the motor is attached, it is indispensable to employ a structure where the motor does not move relative to a motor attachment portion. The reason is that when the motor moves, for example, the engagement between a motor gear and a gear which meshes thereto becomes incomplete, so that the transmission of the power to the actuating parts becomes insufficient.

Thus, when the motor is attached to the motor attachment portion, while the motor is held tightly by a motor holding plate, the motor is fixed by screwing of the motor holding plate.

With a motor carried in a racing vehicle toy or the like, there is a case that it is preferable to change the motor according to the particular race courses (for example, there are many curves or the like). However, with the toy where the motor holding plate is screwed, because the screw is required to be detached and attached during the exchange of the motor, it is a bother. With a motor to which a conductive wire is adhered, the conductive wire is required to be attached and detached with solder, so that it is much bother.

SUMMARY OF THE INVENTION

The present invention is attained in view of such problems. An object of the present invention is to provide an attachment structure for a motor and a toy, such as a racing vehicle toy or the like, wherein it is possible to easily attach a motor thereto and remove therefrom.

In accordance with the first aspect of the present invention, an attachment structure for a motor for a toy, for setting a motor in a motor containing part provided in a base body of a toy, comprises a motor holding plate capable of turning on a predetermined rotational shaft line attached to the base body. The motor holding plate is capable of taking up an open position for opening the motor containing part and a close position for closing the motor containing part by turning. The motor holding plate holds a body part of the motor set in the motor containing part at the close position. The motor holding plate comprises an engaging portion which is capable of engaging with an engage portion provided on the base body with elasticity of the engaging portion or the engage portion when the motor holding plate is disposed at the close position.

The "base body" means a portion forming the motor containing part and its vicinity. The base body may comprise only one member, or two or more members combined with each other. The "rotational shaft line" may extend in a direction parallel to or in a direction crossing (for example, intersecting at right angles) the shaft of the motor set in the motor containing part. Further, the "engage portion" may be a projection, an edge of a hole or the like. The point is that the engage portion may be any one such that the engaging piece can engage with the engage portion with elasticity of the engaging piece or the engage portion. The material of the "motor holding plate" may be metal or synthetic resin. The "attachment structure for motor for toy" may be applied to a vehicle toy, a robot toy, a doll toy or other toys. Although the type of the toy is not limited, the attachment structure is particularly useful when it is applied to a toy of which a motor is often exchanged for other ones. The "opening the motor containing part" does not mean complete opening of the motor containing part, but includes an opening such that the motor can be attached to and removed from the motor containing part. The "closing the motor containing part" does not need to close the whole motor containing part, and includes such a closing as will obstruct the attachment and removal of the motor.

According to the attachment structure for a motor, the motor can be set in the motor containing part by turning the motor holding plate to the open position. Thereafter the motor holding plate is turned to the close position, and the engaging piece is elastically engaged with the engage portion of the base body. Thus the motor can be fixed. On the other hand, when the force is applied to the engaging piece which is elastically engaged with the engage portion of the base body, the engagement is released. Thereafter, the motor holding plate is turned to the open position, so that the motor can be removed from the motor containing part.

With the attachment structure for a motor, it is preferable that the rotational shaft line is parallel to a shaft of the motor set in the motor containing part, and the engage portion is provided on an opposite side of the motor containing part with respect to the rotational shaft line.

According to the attachment structure for a motor, the rotational shaft line of the motor holding plate extends in parallel with the shaft of the motor, so that the periphery of the body part is approximately uniformly held by the motor holding plate. Furthermore, the engage portion is provided on the position which is the opposite side of the motor containing part with respect to the rotational shaft line, so that the motor holding plate holds surely the motor.

It is preferable that the motor holding plate serves as a heat radiator or radiation plate. In order for the motor holding plate to serve as a radiation plate, the "motor holding plate" is required to be made of material which radiates heat. For that purpose, it is preferable that the "motor holding plate" is made of metal, such as copper or aluminum. However, the motor holding plate may be made of synthetic resin or the like (for example, ABS resin) if it has a structure that promotes high heat radiation, such as the use of slits and holes, as described below.

According to the attachment structure, the motor holding plate serves as the radiation plate, so that there is no need to set extra radiation plate and radiation mechanism in the attachment structure.

With the attachment structure for a motor for a toy, the motor may be a DC motor where terminals are provided on a rear side and a body part, the motor containing part may be provided with conductive pieces which may be electrically connected to each of the terminals of the motor, and when the motor is fitted in the motor containing part, the corresponding conductive piece may be electrically connected to each of the terminals.

According to the structure, the conductive pieces which are electrically connected to respective terminals of the motor are set in the motor containing part, so that each terminal of the motor, when the motor is fitted in the motor containing part, is electrically connected to each conductive piece immediately.

The motor may be a DC motor where terminals are provided on a rear side and a body part, and the motor containing part may be provided with a conductive piece which is electrically connected to the terminal on the rear side of the motor. The motor holding plate may be made of conductive material so as to be electrically connected to the terminal on the body part of the motor. The conductive piece may be electrically connected to the terminal on the rear side of the motor when the motor is fitted in the motor containing part. Further, when the motor holding plate is moved to the close position while the motor is set in the motor containing part, the motor holding plate may be electrically connected to the terminal on the body part of the motor.

According to the attachment structure for motor, the conductive piece which is electrically connected to the terminal on the rear side of the motor may be set in the motor containing part, so that the terminal on the rear side of the motor, when the motor is fitted in the motor containing part, may be electrically connected to the conductive piece immediately. Further, when the motor holding plate is moved to the close position while the motor is set in the motor containing part, the motor holding plate may be electrically connected to the terminal on the body part of the motor immediately.

According to the second aspect of the present invention, a toy comprises a base body provided with a battery containing part for containing a battery and a motor containing part for containing a cylindrical motor;

the cylindrical motor contained in the motor containing part; and a motor holding member capable of turning on a shaft approximately parallel to a rotational shaft of the cylindrical motor, the motor holding member capable of taking up an open position for opening the motor containing part and a close position for closing the motor containing part by the turn, and the motor holding member comprising an engaging portion which is capable of elastically engaging with an engage portion provided on the base body while the engaging portion holds an exposed peripheral portion of the motor set in the motor containing part at the close position.

Preferably, the motor containing part of the base body is provided with a first electrode piece connected to one electrode of the battery at one position with which a peripheral body part of the motor is brought into contact, and a second electrode piece connected to another electrode of the battery at a different position which is insulated to the one position. The motor may be a DC motor, and at least a portion of the peripheral body part may serve as one of positive and negative terminals of the motor.

It is preferable that a rear side of the motor is provided with the other of the positive and negative terminals of the motor, and the motor can be contained in the motor containing part such that the peripheral body part is connected to the first electrode piece while the rear side is connected to the second electrode piece.

According to the toy with the above structure, by turning the motor holding plate to the close position and by elastically engaging the engaging piece with the engage portion of the base body, the motor can be fixed, and at the same time, the positive and negative terminals of the motor can be electrically connected to the pair of electrode pieces.

According to the third aspect of the present invention, a racing vehicle (racing car) toy comprises an attachment structure for a motor for a toy. The attachment structure comprises a motor holding plate capable of turning on a predetermined rotational shaft line attached to the base body. The motor holding plate is capable of taking up an open position for opening the motor containing part and a close position for closing the motor containing part by turning. The motor holding plate holds a body part of the motor set in the motor containing part at the close position. The motor holding plate comprises an engaging portion which, when the motor holding plate is disposed at the close position, is capable of engaging with an engage portion provided on the base body with elasticity of the engaging portion or the engage portion.

According to the racing vehicle toy, the user has only to turn the motor holding plate for exchanging the motor according to the racing course.

DESCRIPTION OF THE EMBODIMENTS

Figure 1:
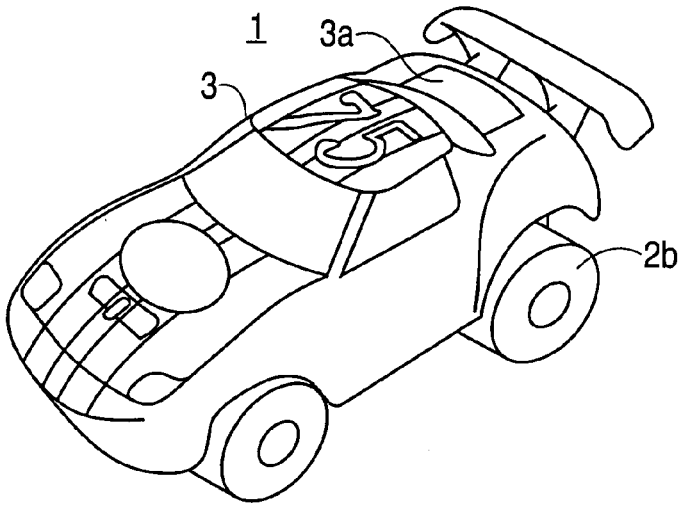
FIG. 1 is a perspective view of a racing vehicle toy according to an embodiment of the present invention.
Figure 2:
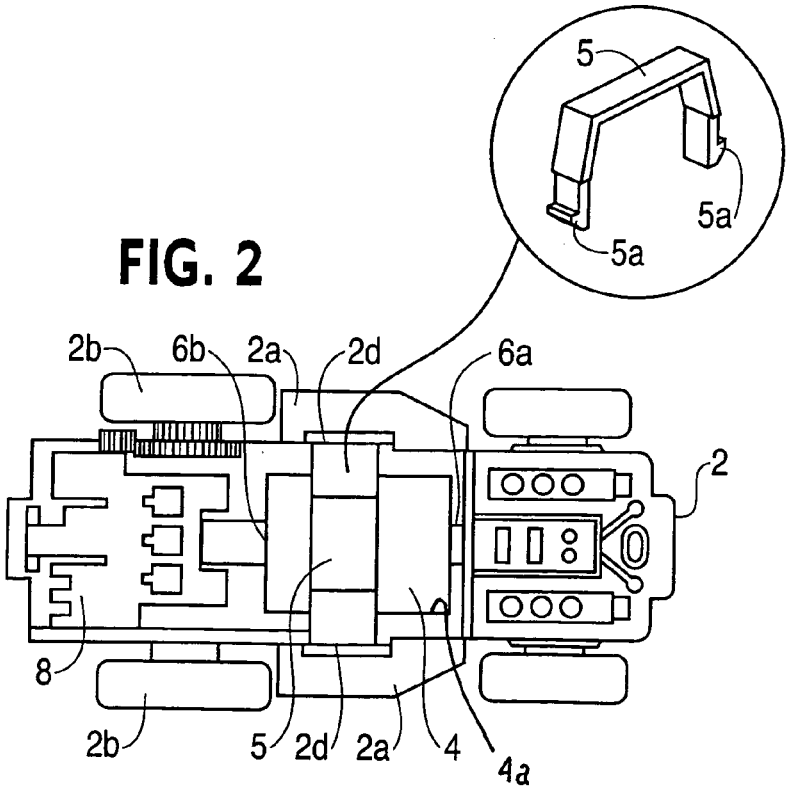
FIG. 2 is a plan view of a chassis of the racing vehicle toy of FIG. 1.

FIG. 1 is a perspective view of a racing vehicle (racing car) toy to which an attachment structure for motor according to the embodiment is applied. A housing of the vehicle toy 1 includes a chassis (base body) 2 and a body 3 as shown in FIG. 1 and FIG. 2. The chassis 2 and the body 3 are made of plastic or the like. A side portion of the body 3 has some elasticity. Each inside of the side portion has a recess portion (engage portion) which is elastically engaged with a projection portion 2*a* on opposite sides of the chassis 2, so that the body 3 is fixed with the chassis 2, which is not limited to such a structure. Preferably, a rear portion of the body 3 is provided with an opening 3*a* for improving the radiation effect of an after-mentioned motor 11.

FIG. 2 is a plan view of the chassis 2. A chargeable battery (for example, Ni—Cd battery) 4 is longitudinally set in a central portion of the chassis 2, however, it is not limited to that. This battery 4 is attached to a battery containing part 4*a* by an attachment member 5. This attachment member 5 is made of plastic or the like, and formed into an inverted U-shape so that the attachment member 5 can hold a body part of the battery 4. Both free end portions of the attachment member 5 have at least elasticity and are capable of deforming in directions of coming close to and going away from each other. An outside of each free end portion is provided with an engaging pawl (engage portion) 5*a*. The engaging pawls 5*a* are hooked on edges (engage portions) of hole portions 2*d* of the chassis 2, so that the battery 4 can be fixed. The front and rear sides of the battery containing part are provided with conductive pieces 6*a* and 6*b* which can be electrically connected to a negative electrode and a positive electrode of the battery 4. The conductive pieces 6*a* and 6*b* are partially exposed to a bottom side of the chassis 2, which is not shown. The exposed conductive pieces 6*a* and 6*b* are used for charging the battery 4.

Figure 3:
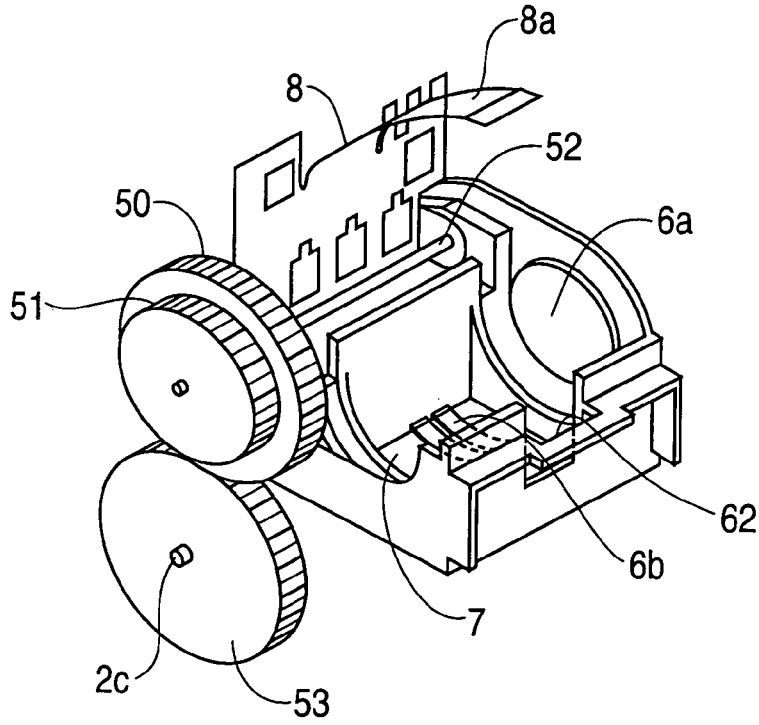
FIG. 3 is a perspective view of a motor containing part of the racing vehicle of FIG. 1.
Figure 4:
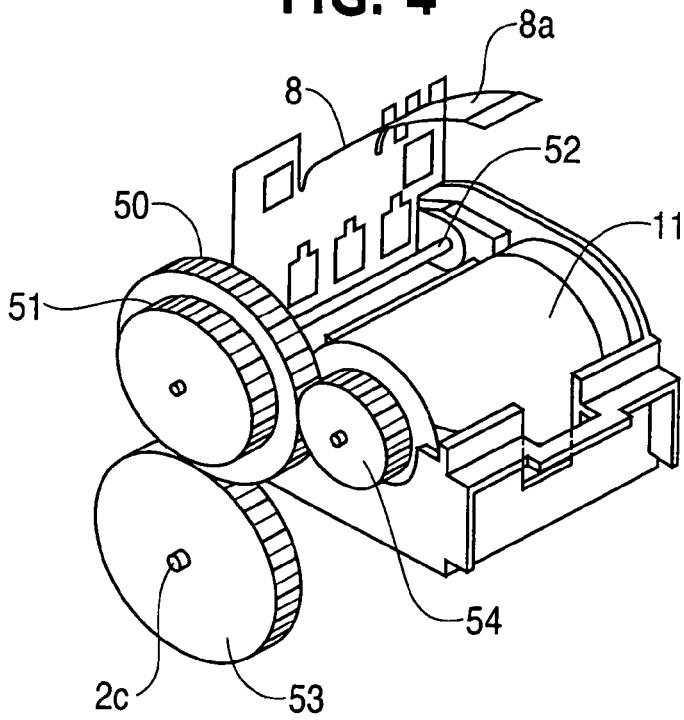
FIG. 4 is a perspective view of a motor containing part of the racing vehicle toy of FIG. 1.

A rear portion of the chassis 2 is provided with a motor containing part 7, as shown in FIG. 3. The motor 11 is transversely installed in the motor containing part 7, as shown in FIG. 4.

Figure 5:
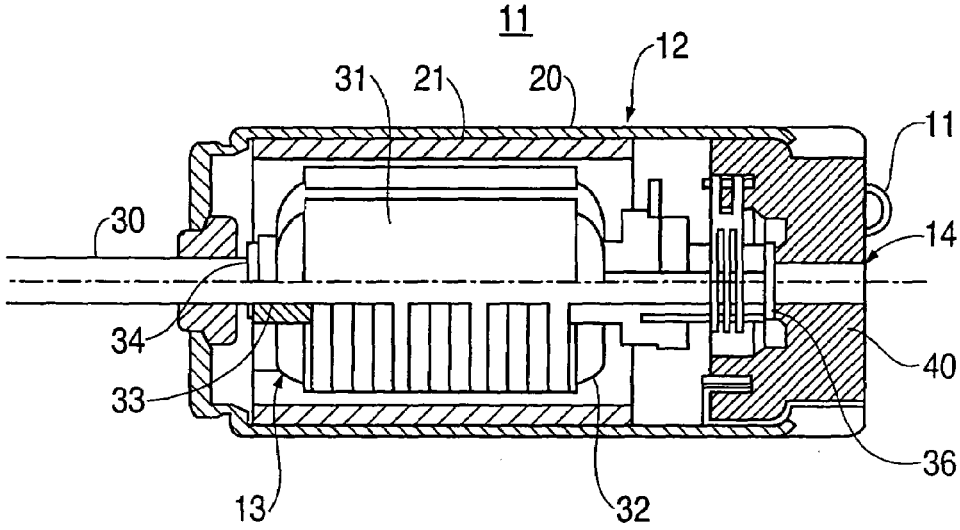
FIG. 5 is a cross sectional view of a motor employed for the racing vehicle toy of FIG. 1.

The motor 11 put in the motor containing part 7 is a DC motor and comprises a large case assembly 12, a completed rotor 13, and a small case assembly 14, as shown in FIG. 5. Hereinafter, the large case assembly 12, the completed rotor 13, and the small case assembly 14 will be explained in order, as follows.

Figure 6:
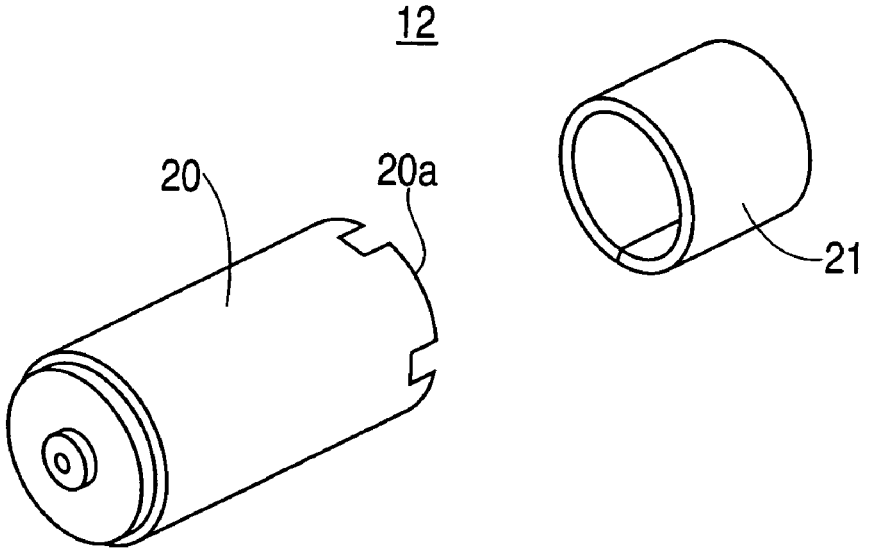
FIG. 6 is an exploded perspective view of a large case assembly of the motor of FIG. 5.

The large case assembly 12 comprises a large case (body part) 20 with an opening 20*a* which is formed at the rear side thereof, as shown in FIG. 6. The large case 20 is made of a conductive material.

With the large case assembly 12, a magnetic stator 21 is disposed in the large case 20. The stator 21 is generally made of a permanent magnet or an electro-magnet, to produce a constant magnetic field in the motor 11. In the embodiment, a permanent magnet is used as the stator 21.

Figure 7:
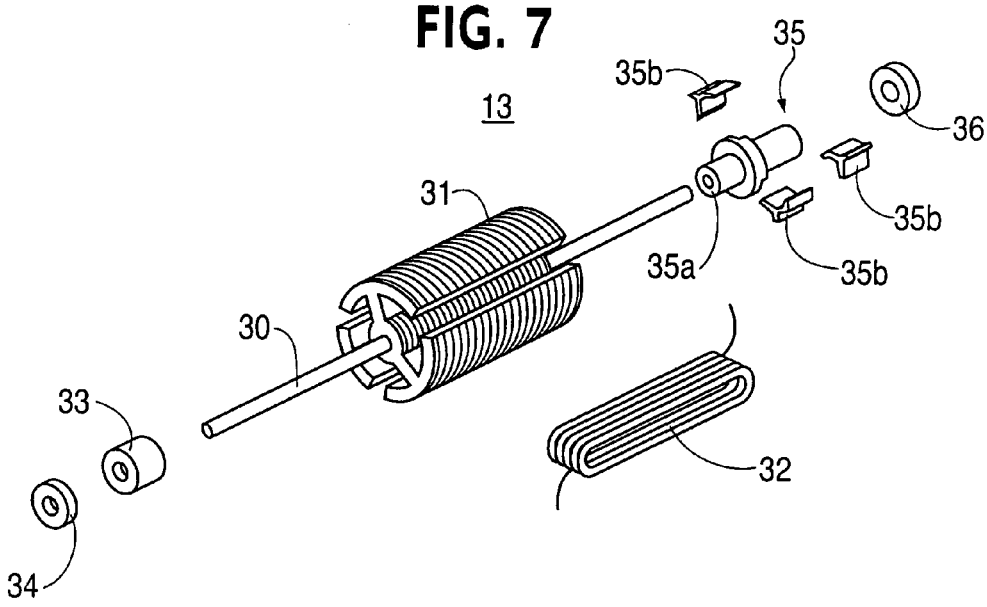
FIG. 7 is an exploded perspective view of a completed rotor of motor of FIG. 5.

The completed rotor 13 comprises a core 31 attached to a rotary shaft 30, a driving coil 32 wound around the core 31, a sleeve 33 and a thrust ring 34 which are disposed in an end side on the rotary shaft 30 for sandwiching the core 31, and a commutator 35 and oil cutter 36 which are disposed in the other end side on the rotary shaft 30, as shown in FIG. 7. The commutator 35 comprises a central member 35*a* and commutator pieces 35*b* which are attached to the central member 35*a*.

The small case assembly 14 comprises a small case 40 (FIG. 8) which is fitted in the large case 20 to cover the opening 20*a* of the large case 20. The small case 40 is made of an insulating material.

Figure 8:
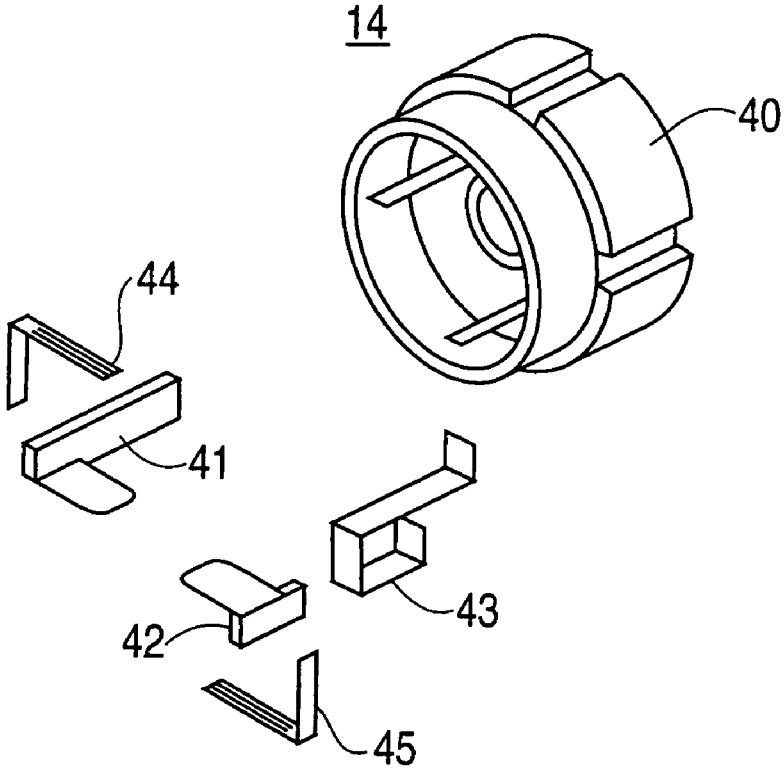
FIG. 8 is an exploded perspective view of a small case assembly of the motor of FIG. 5.

The small case assembly 14 further comprises conductive pieces 41, 42 and 43, and contact springs 44 and 45, which are attached to the small case 40, as shown in FIG. 8. An end of the conductive piece 41 is electrically connected to the negative electrode of the battery 4 to form a negative terminal. The other end of the conductive piece 41 has a structure to be able to electrically connect to the commutator 35 through the contact spring 44. The top end of the conductive piece 41 is bent after the conductive piece 41 was assembled to the small case 40, as shown in FIG. 5. The conductive piece 42 is connected to the large case 20 through the conductive piece 43. The large case 20 is electrically connected to the positive electrode of the battery 4. The conductive piece 42 has a structure to be able to electrically connect to the commutator 35 through the contact spring 45.

Next, the motor containing part 7 will be explained, but it is not limited to the following. One end of the conductive piece 6*a*, which is electrically connected to the negative electrode of the battery 4, extends to a right side wall of the motor containing part 7, as shown in FIG. 3. On the other hand, one end of the conductive piece 6*b*, which is electrically connected to the positive electrode of the battery 4, extends to the bottom of the motor containing part 7. When the motor 11 is installed in the motor containing part 7, as shown in FIG. 4, the negative terminal 41 at the rear side of the motor 11 is automatically, electrically connected to the conductive piece 6*a*, while the positive terminal 20 on the body part is automatically, electrically connected to the conductive piece 6*b*.

Gears 50 and 51 are provided in the vicinity of the left side wall of the motor containing part 7. The gears 50 and 51 are made of plastic or the like, and integrally formed such that the gears 50 and 51 idle about a transversal shaft (rotational shaft) 52. The gear 51 meshes with a gear 53 fixed to a wheel axle 2*c* of rear wheels 2*b* and 2*b*. Then, the rotation of the gear 53 by the motor power drives the rear wheels 2*b* and 2*b*. On the other hand, when the motor 11 is installed in the motor containing part 7, the gear 50 meshes with a gear 54 attached to a shaft of the motor 11.

Figure 9:
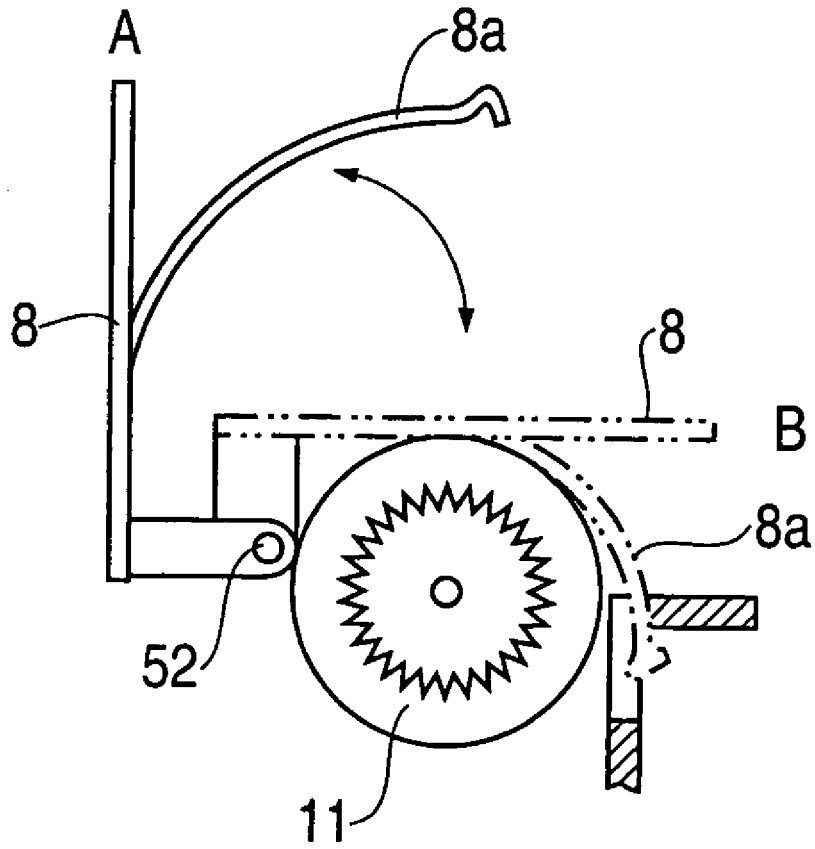
FIG. 9 is a side view showing opening and closing of a motor holding plate of the racing vehicle toy of FIG. 1.

Further, the rear portion of the chassis 2 is provided with a motor holding plate or motor clip 8. The motor holding plate 8 is made of copper, which is not limited to that. Slits and holes are appropriately formed in the motor holding plate 8 to meet both the improvement of the radiation for the motor 11 and the efficiency of holding the motor 11. The motor holding plate 8 is capable of turning on the transversal shaft 52 extending in a lateral direction on the front side of the motor containing part 7. The motor holding plate 8 turns on the transversal shaft 52, so that the motor holding plate 8 can take up an open position (A of FIG. 9) for opening the motor containing part 7 and a close position (B of FIG. 9) for closing the motor containing part 7. At the close position, the motor holding plate 8 can hold the body part of the motor 11 set in the motor containing part 7.

A central portion on the free end of the motor holding plate 8 is curved, and the curved portion serves as an engaging portion or a hook portion 8*a*. The engaging portion 8*a* has elasticity. When the motor holding plate 8 turns on the transversal shaft 52 to move from the open position (A of FIG. 9) to the close position (B of FIG. 9), the engaging portion 8*a* is inserted into a hole portion 62 formed on the rear side of the motor containing part 7 of chassis 2. Then, the engaging portion 8*a* is engaged with an edge (engage portion) of the hole portion 62 by the elasticity of the engaging portion 8*a*.

The method for exchanging the motor 11 in the above-described attachment structure for motor will be explained.

At first, the body 3 is removed from the chassis 2. The motor holding plate 8 is turned on the transversal shaft 52, so that the motor holding plate 8 is moved to the open position (A of FIG. 9). In this state, the motor 11 is removed from the motor containing part 7. By this detachment, the electrical connections between the motor 11 and the conductive pieces 6*a* and 6*b* are released. The engagement between the gear 50 and the gear 54 attached to the shaft of the motor 11 is also released.

Next, another motor 11 is fitted in the motor containing part 7. By this installation, the negative terminal on the rear side of the motor 11 is electrically connected to the conductive piece 6*a*, while the positive terminal on the body part of the motor 11 is electrically connected to the conductive piece 6*b*. The gear 54 attached to the shaft of the motor 11 engages with the gear 50. Then, the motor holding plate 8 is turned on the transversal shaft 52 so as to move to the close position (B of FIG. 9). The engaging piece 8*a* is engaged with the edge (engage portion) of the hole portion 62. Thus, the motor 11 is fixed in the chassis 2. Thereafter, the body 3 is attached to the chassis 2.

It should also be understood that the present invention is not limited to the embodiment as the above described and various changes and modifications may be made to the invention without departing from the gist thereof.

For example, although the large case 20 makes a positive terminal in the above-described embodiments, the large case 20 may make a negative terminal. Two electrically separated regions formed on the large case 20 can also be adopted as positive and negative terminals. An exposed portion of an inner case which is provided in the large case 20 can also be adopted as a terminal. Although the large case 20 is used as a terminal in the above-described embodiments, it is possible to use the periphery of the small case 40 as the terminal instead of the large case 20.

As described above, according to the attachment structure for a motor for a toy of the present invention, the motor is easily set in and removed from the motor containing part by opening the motor holding plate, and easily fixed to the motor containing part by elastically engaging the engaging piece of the motor holding plate to the engage portion.

According to the racing vehicle (racing car) toy of the present invention, the user has only to turn the motor holding plate for exchanging the motor according to the racing course, so handling is easy.

The entire disclosure of Japanese Patent Application No. Tokugan 2000-337726 filed on Nov. 6, 2000 including specification, claims, drawings and summary are incorporated herein by reference in its entirety.

What is claimed is:

1. An attachment structure to hold a motor in a motor containing part provided in a base body of a toy, comprising:

a motor holding plate pivotably movable on a first shaft attached to the base body, between a first position, wherein the motor containing part is open, and a second position wherein the motor containing part is closed, the motor holding plate holding the motor in the motor containing part while in the second position, and the motor holding plate including a member which is received by an engage portion provided on the base body when the motor holding plate is in the second position, wherein, when the motor holding plate is in the second position, the motor holding plate contacts the motor, the motor is contained in the motor containing part and the motor is electrically connected to a power source, and when the motor holding plate is in the first position, the motor holding plate does not contact the motor, the motor can be removed from the motor containing part, and the motor is not connected to the power source.

2. The attachment structure of claim 1, wherein the first shaft is parallel to a second shaft of the motor held in the motor containing part, and the engage portion is provided on an opposite side of the motor containing part with respect to the first shaft.

3. The attachment structure of claim 1, wherein the motor is a substantially cylindrical DC motor with terminals provided on a on a first area of the motor and on a second area of the motor, the motor containing part is provided with electrically conductive pieces which are electrically connected to each of the terminals of the motor, and when the motor is held in the motor containing part, the corresponding conductive piece is electrically connected to each of the terminals.

4. The attachment structure of claim 1, wherein the motor is a DC motor with terminals provided on a first area of the motor and a second area of the motor, respectively, the motor containing part is provided with an electrically conductive piece, the motor holding plate is made of an electrically conductive material, the conductive piece is electrically connected to the terminal on the first area of the motor and the motor holding plate is electrically connected to the terminal on the second area of the motor, when the motor is held in the motor containing part, and the motor holding plate is moved to the second position.

5. The attachment structure of claim 1, wherein the motor holding plate comprises a material that dissipates heat from the motor.

6. The attachment structure of claim 5, wherein the material is a metal.

7. The attachment structure of claim 6, wherein the metal is copper or aluminum.

8. The attachment structure of claim 1, wherein the motor holding plate has a shape that promotes dissipation of heat from the motor.

9. The attachment structure of claim 1, wherein the motor holding plate is either a metal or a synthetic resin, and further includes at least one opening to allow heat to dissipate from the motor.

10. The attachment structure of claim 1, wherein the member elastically engages the engage portion of the base body.

11. A toy, comprising:

a base body provided with a battery containing part to contain a battery, and a motor containing part to contain a motor; and a motor holding member to pivotably move between an open position to open the motor containing part and a closed position to close the motor containing part, and the motor holding member including a member removably engaged with the base body, when the motor holding member is in the closed position, wherein, when the motor holding member is in the closed position, the motor holding member contacts the motor, the motor is contained in the motor containing part and the motor is electrically connected to a power source, and when the motor holding member is in the open position, the motor holding member does not contact the motor, the motor can be removed from the motor containing part, and the motor is not connected to the power source.

12. The toy of claim 11, wherein the motor containing part has a first electrode connected to one electrode of the battery at a first position with which a peripheral body part of the motor is brought into contact, and a second electrode connected to another electrode of the battery at a second different position which is insulated relative to the first position, the motor is a DC motor, and at least a portion of the peripheral body part serves as one of positive and negative terminals of the motor.

13. The toy of claim 12, wherein a rear side of the motor is provided with the other of the positive and negative terminals of the motor, and the motor is contained in the motor containing part such that the peripheral body part is connected to the first electrode while the rear side is connected to the second electrode.

14. The toy of claim 11, wherein the motor holding member comprises a material that dissipates heat from the motor.

15. The toy of claim 14, wherein the material is a metal.

16. The toy of claim 15, wherein the metal is copper or aluminum.

17. The toy of claim 11, wherein the motor holding member has a shape that promotes dissipation of heat from the motor.

18. The toy of claim 11, wherein the motor holding member is either a metal or a synthetic resin, and further includes at least one opening to allow heat to dissipate from the motor.

19. The toy of claim 11, wherein the member elastically engages the engage portion of the base body.

20. The toy of claim 11, further comprising a body attached to the base body, wherein said body includes an opening to promote the dissipation of heat from the motor.

21. The toy of claim 20, wherein the body is removably attached to the base body.

22. A racing vehicle toy, comprising:

an attachment structure for holding a motor in a motor containing part provided in a base body of the toy, the attachment structure including:

a motor holding plate that pivots relative to the base body between an open position to open the motor containing part and a closed position to close the motor containing part, the motor holding plate holds the motor in the motor containing part in the closed position, and the motor holding plate includes a member removably engaged with the base body, when the motor holding plate is in the closed position, wherein, when the motor holding plate is in the closed position, the motor holding plate contacts the motor, the motor is contained in the motor containing part and the motor is electrically connected to a power source, and when the motor holding plate is in the open position, the motor holding plate does not contact the motor, the motor is not in the motor containing part, and the motor is not connected to the power source.

23. The racing vehicle toy of claim 22, wherein the motor holding plate pivots on a first shaft which is parallel to a second shaft of the motor, when the motor is contained in the motor containing part, and the member is removably engaged on an opposite side of the motor containing part with respect to the first shaft.

24. The racing vehicle toy of claim 22, wherein the motor is a DC motor with terminals provided on first and second spaced areas thereof, the motor containing part being provided with electrically conductive pieces which are electrically connected to each of the terminals of the motor, and when the motor is contained in the motor containing part, the corresponding conductive piece is electrically connected to each of the terminals.

25. The racing vehicle toy of claim 22, wherein the motor is a DC motor with terminals provided on first and second spaced areas thereof, respectively, the motor containing part being provided with an electrically conductive piece, the motor holding plate is made of an electrically conductive material, the conductive piece is electrically connected to the terminal on the first area of the motor, and the motor holding plate is electrically connected to the terminal on the second area of the motor, when the motor is held in the motor containing part, and the motor holding plate is moved to the closed position.

26. The racing vehicle toy of claim 22, wherein the motor holding plate comprises a material that dissipates heat from the motor.

27. The racing vehicle toy of claim 26, wherein the material is a metal.

28. The racing vehicle toy of claim 27, wherein the metal is copper or aluminum.

29. The racing vehicle toy of claim 22, wherein the motor holding plate has a shape that promotes dissipation of heat from the motor.

30. The racing vehicle toy of claim 29, wherein the motor holding plate comprises at least one of a metal and a synthetic resin, and further includes at least one opening to allow heat to dissipate from the motor.

31. The racing vehicle toy of claim 22, wherein the member elastically engages the engage portion of the base body.

32. The toy of claim 22, further comprising a body that is attached to the base body, wherein said body includes an opening to promote dissipation of heat from the motor.

33. The toy of claim 32, wherein the body is removably attached to the base body.

34. A toy, comprising:

a toy chassis; and a motor attachment plate attached on one side to a rotational shaft attached to the toy chassis to rotate between an open position and a closed position, wherein the plate is detachably attached to the toy chassis on an opposing side, and the plate serves as a heat radiation plate, wherein, when the motor attachment plate in the closed position, the motor attachment plate contacts the motor, the motor is contained in a motor containing part and the motor is electrically connected to a power source, and when the motor attachment plate is in the open position, the motor attachment plate does not contact the motor, the motor can be removed from the motor containing part, and the motor is not connected to the power source.

35. A toy, comprising:

a chassis;

a motor containing part on the chassis;

a motor removably mounted in the motor containing part;

a motor clip rotatably attached at a first end to a shaft on the chassis adjacent the motor containing part, said shaft being approximately parallel to a rotational shaft of the motor, and pivoting between open and closed positions relative to the motor containing part, wherein a second end of the clip is detachably engaged to the chassis adjacent the motor containing part, to facilitate removal and replacement of the motor relative to the motor containing part, wherein, when the motor clip is in the closed position, the motor clip contacts the motor, the motor is contained in the motor containing part and the motor is electrically connected to a power source, and when the motor clip is in the open position, the motor clip does not contact the motor, the motor can be removed from the motor containing part, and the motor is not connected to the power source.

36. A racing vehicle toy, comprising:

a toy chassis; and a motor clip rotatably attached on one side to a shaft attached to a base body of the toy chassis to pivot between open and closed positions relative to a motor containing part of a base body of the toy, an opposing side of said clip being removably attached to the base body, wherein, when the motor clip is in the closed position, the motor clip contacts the motor, the motor is contained in the motor containing part and the motor is electrically connected to a power source, and when the motor clip is in the open position, the motor clip does not contact the motor, the motor can be removed from the motor containing part, and the motor is not connected to the power source.

37. An attachment structure to hold a motor in a motor containing part provided in a base body of a toy, comprising:

a motor holding plate movable on a shaft attached to the base body, between a first position, wherein the motor containing part is open, and a second position wherein the motor containing part is closed, the motor holding plate holding a body part of the motor in the motor containing part while in the second position, and the motor holding plate including a member which is received by an engage portion provided on the base body when the motor holding plate is in the second position, wherein the motor is a DC motor with terminals provided on a rear side and on the body part, the motor containing part is provided with electrically conductive pieces which are electrically connected to each of the terminals of the motor, and when the motor is held in the motor containing part, the corresponding conductive piece is electrically connected to each of the terminals.

38. An attachment structure to hold a motor in a motor containing part provided in a base body of a toy, comprising:

a motor holding plate movable on a staff attached to the base body, between a first position, wherein the motor containing part is open, and a second position wherein the motor containing part is closed, the motor holding plate holding a body part of the motor in the motor containing part while in the second position, and the motor holding plate including a member which is received by an engage portion provided on the base body when the motor holding plate is in the second position, wherein the motor is a DC motor with terminals provided on a rear side and the body part, respectively, the motor containing part is provided with an electrically conductive piece, the motor holding plate is made of an electrically conductive material, the conductive piece is electrically connected to the terminal on the rear side of the motor and the motor holding plate is electrically connected to the terminal on the body part of the motor, when the motor is held in the motor containing part, and the motor holding plate is moved to the second position.

39. A toy, comprising:

a base body provided with a battery containing part to contain a battery, and a motor containing part to contain a motor; and a motor holding member to pivotably move between an open position to open the motor containing part and a closed position to close the motor containing part, and the motor holding member including a member removably engaged with the base body, when the motor holding member is in the closed position, wherein the motor containing part has a first electrode connected to one electrode of the battery at a first position with which a peripheral body part of the motor is brought into contact, and a second electrode connected to another electrode of the battery at a second different position which is insulated relative to the first position, the motor is a DC motor, and at least a portion of the peripheral body part serves as one of positive and negative terminals of the motor.

40. The toy of claim 39, wherein a rear side of the motor is provided with the other of the positive and negative terminals of the motor, and the motor is contained in the motor containing part such that the peripheral body part is connected to the first electrode while the rear side is connected to the second electrode.

41. A racing vehicle toy, comprising:

an attachment structure for holding a motor in a motor containing part provided in a base body of the toy, the attachment structure including:

a motor holding plate that pivots relative to the base body between an open position to open the motor containing part and a closed position to close the motor containing part, the motor holding plate holds the motor in the motor containing part in the closed position, and the motor holding plate includes a member removably engaged with the base body, when the motor holding plate is in the closed position, wherein the motor is a DC motor with terminals provided on a rear side and a body part thereof, the motor containing part being provided with electrically conductive pieces which are electrically connected to each of the terminals of the motor, and when the motor is contained in the motor containing part, the corresponding conductive piece is electrically connected to each of the terminals.

42. A racing vehicle toy, comprising:

an attachment structure for holding a motor in a motor containing part provided in a base body of the toy, the attachment structure including:

a motor holding plate that pivots relative to the base body between an open position to open the motor containing part and a closed position to close the motor containing part, the motor holding plate holds the motor in the motor containing part in the closed position, and the motor holding plate includes a member removably engaged with the base body, when the motor holding plate is in the closed position, wherein the motor is a DC motor with terminals provided on a rear side and a body part thereof, respectively, the motor containing part being provided with an electrically conductive piece, the motor holding plate is made of electrically conductive material, the conductive piece is electrically connected to the terminal on the rear side of the motor, and the motor holding plate is electrically connected to the terminal on the body part of the motor, when the motor is held in the motor containing part, and the motor holding plate is moved to the closed position.

* * * * *

UNITED STATES PATENT AND TRADEMARK OFFICE

CERTIFICATE OF CORRECTION

PATENT NO. : 6,971,941 B2
DATED : December 6, 2005
INVENTOR(S) : Yoshinobu Kaneko It is certified that error appears in the above-identified patent and that said Letters Patent is hereby corrected as shown below:

Column 7,
Line 63, delete “on a”.

Column 9,
Line 39, change “is not in” to -- can be removed from --.

Column 10,
Line 31, after “plate” insert -- is --.

Signed and Sealed this

Eleventh Day of April, 2006

JON W. DUDAS
*Director of the United States Patent and Trademark Office*